United States Patent [19]

Ripley

[11] 4,396,298

[45] Aug. 2, 1983

[54] CASE FOR ELECTRONIC WATCH MODULE

[75] Inventor: Richard Ripley, Attleboro, Mass.

[73] Assignee: Textron, Inc., Providence, R.I.

[21] Appl. No.: 289,786

[22] Filed: Aug. 3, 1981

[51] Int. Cl.[3] ..... G04B 37/00

[52] U.S. Cl. ..... 368/300; 368/282; 368/276; 368/321

[58] Field of Search ..... 368/276–279, 368/281–283, 286, 288, 293, 300, 309, 311, 312, 313, 316, 317, 69, 70, 319, 321

[56] References Cited

U.S. PATENT DOCUMENTS

| | | | |
|---|---|---|---|
| 1,539,744 | 5/1925 | Kelly . | |
| 1,850,216 | 3/1932 | Ryland . | |
| 1,986,328 | 1/1935 | Dreyfus | 58/10 S |
| 2,342,804 | 2/1944 | Hiller | 224/4 |
| 2,590,572 | 3/1952 | Rasmusser | 224/4 |
| 2,595,330 | 5/1952 | Brown | 58/105 |
| 2,679,785 | 6/1954 | Batt | 88/39 |
| 2,706,379 | 5/1955 | Fitzpatrick, Jr. | 58/88 |
| 2,815,640 | 12/1957 | Kirshner | 58/88 |
| 3,470,638 | 10/1969 | Friedman et al. | 40/107 |
| 3,526,985 | 9/1970 | Rieth | 40/117 |
| 3,593,449 | 7/1971 | Nielson | 40/140 |
| 3,769,726 | 11/1973 | Spence | 40/21 C |
| 3,968,640 | 7/1976 | Clemmer et al. | 58/50 R |
| 3,992,870 | 11/1976 | Dekel | 368/280 |
| 4,135,358 | 1/1979 | Ricca | 58/23 R |

FOREIGN PATENT DOCUMENTS

| | | | |
|---|---|---|---|
| 1253641 | 11/1967 | Fed. Rep. of Germany | 368/300 |
| 619099 | 9/1980 | Switzerland | 368/276 |
| 682953 | 3/1952 | United Kingdom . | |

*Primary Examiner*—Bernard Roskoski

*Attorney, Agent, or Firm*—Thompson, Birch, Gauthier & Samuels

[57] ABSTRACT

A case is disclosed for containing an electronic watch module of the type having a display face and internal function switches manually operable by means of externally protruding depressible control buttons. The case includes a base component defining an open cavity for receiving the watch module, and a cover component with a window. Fasteners are employed to assemble the cover component to the base component at a position overlying the watch module, with the module display face visible through the cover window. Access openings in the assembled combination of the base and cover components are aligned with the module control buttons, and a spring is interposed between the module and the base component to resiliently urge the module into a fixed position within the case. The control buttons are concealed behind depressible spring contact sections which protrude outwardly through the access openings to provide a neat decorative appearance.

12 Claims, 6 Drawing Figures

FIG.1
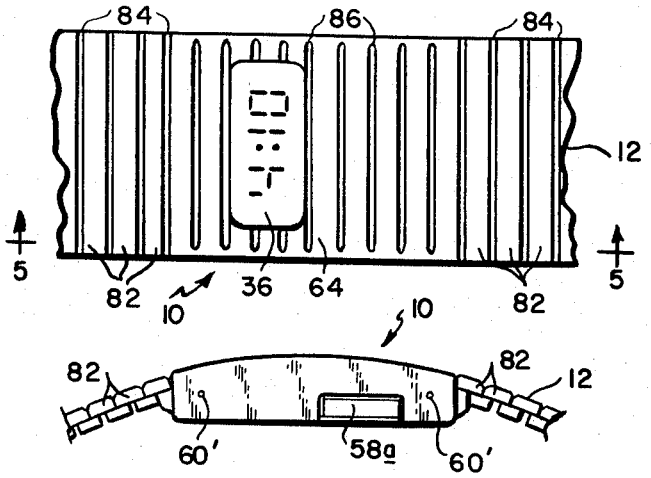
FIG.2
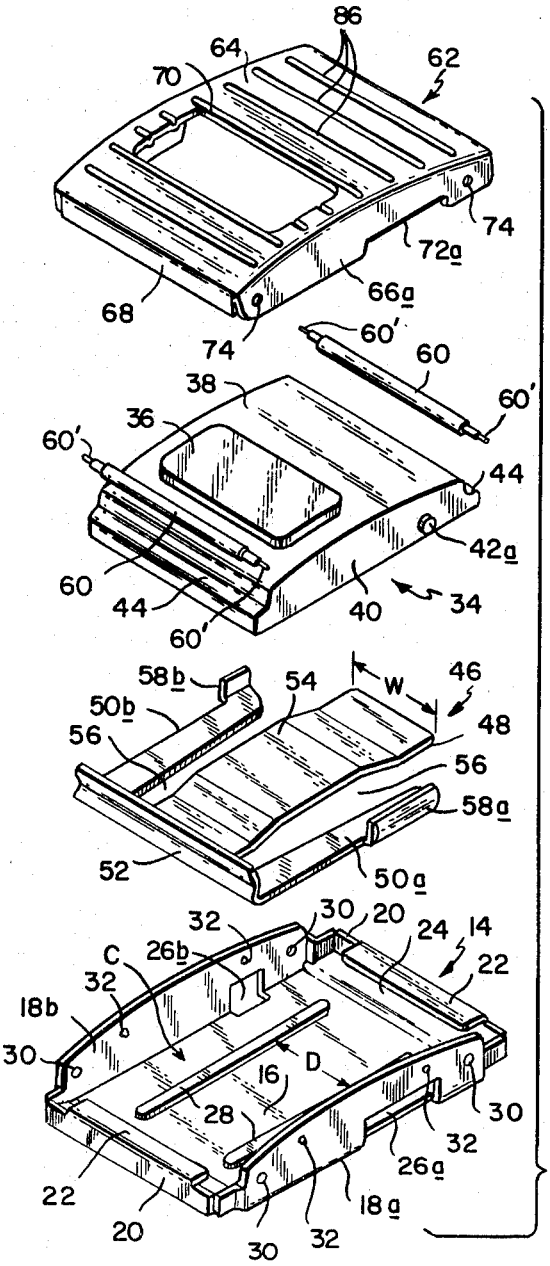
FIG.3
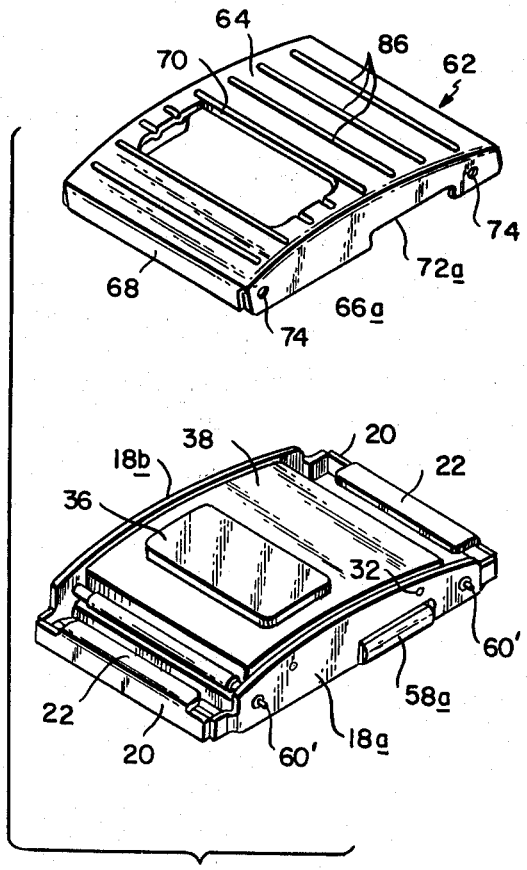
FIG.4

CASE FOR ELECTRONIC WATCH MODULE

BACKGROUND OF THE INVENTION (1) Field of the Invention

This invention relates generally to electronic watches, and more particularly to an improved case for housing an electronic watch module.

(2) Description of the Prior Art

The electronic watch making art has progressed to a point where highly reliable, accurate digital watch modules are now widely available at a relatively low cost as compared with the more traditional watch components incorporating mechanical movements. However, the art of designing and manufacturing cases for such modules has lagged behind, and thus conventional cases for electronic watch modules are either unattractive or of such a complicated nature that their costs exceed those of the modules that they are designed to contain. Appearance is often compromised by the unsightly module control buttons which protrude through the casing wall. As shown for example in U.S. Pat. No. 3,975,899, costs are increased unnecessarily by employing an excessive number of specially machined components requiring complicated assembly procedures. One recent example of attempted cost-savings in the design of such cases is disclosed in U.S. Pat. No. 4,229,936 where the case is formed as an integral part of a resilient plastic or rubber strap, to which is attached a metal cover. This type of assembly may be satisfactory for certain uses, such as for example sport watches, where a more decorative finished appearance is not required. The same would not hold true, however, for situations demanding a more finished or "dress" appearance.

SUMMARY OF THE INVENTION

The present invention has as its basic objective the provision of an improved metal case for an electronic watch module which is both inexpensive and characterized by a highly attractive finished appearance. Another object of the prevent invention is the provision of a case which is capable of securely and safely containing an electronic watch module. A still further object of the present invention is the provision of a metal case which can be disassembled easily to afford access to an electronic watch module contained therein when periodic maintenance is required, for example when changing the battery.

The case of the present invention is particularly suited for use with an electronic watch module of the type having a display face and internal function switches manually operable by means of externally protruding depressible control buttons. In accordance with the present invention, the case includes a base component in the form of a metal stamping defining an open cavity for receiving the watch module. A cover component consisting of a second metal stamping with a viewing window is detachably fastened to the base component at a position overlying the watch module in the aforesaid cavity, with the display face of the watch module being observable through the viewing window of the cover component. Access openings are provided in the assembled combination of the base and cover components in alignment with the control buttons on the watch module. A spring is interposed between the watch module and the base component for resiliently urging the watch module into a fixed position within the case. The spring consists of a third unitary metal stamping having a first leaf interposed between the bottom of the watch module and the bottom wall of the base component, and resilient second leaves which extend along the sides of the watch module and which include integral contact sections. These contact sections overlap the depressible buttons of the watch module and protrude through the aligned access openings in the case, thus concealing the control buttons from view.

DESCRIPTION OF THE DRAWINGS

FIG. 1 is a top plan view of a case in accordance with the present invention, shown connected to opposite ends of an expansible linkage bracelet;

FIG. 2 is a side elevational view of the case and bracelet shown in FIG. 1;

FIG. 3 is an exploded perspective view of the watch case and the electronic watch module to be enclosed therein;

FIG. 4 is another exploded perspective view showing the watch module mounted within the base component with only the cover component removed;

DETAILED DESCRIPTION OF PREFERRED EMBODIMENT

Figure 5:
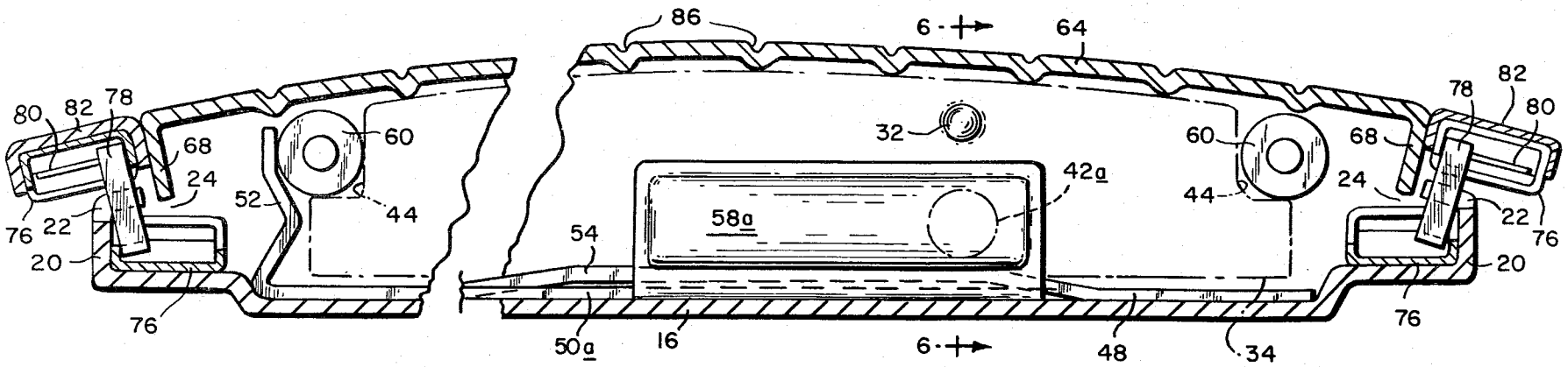
FIG. 5 is an enlarged sectional view taken along line 5—5 of FIG. 1; and, FIG. 6 is a sectional view taken along line 6—6 of FIG. 5.
Figure 6:
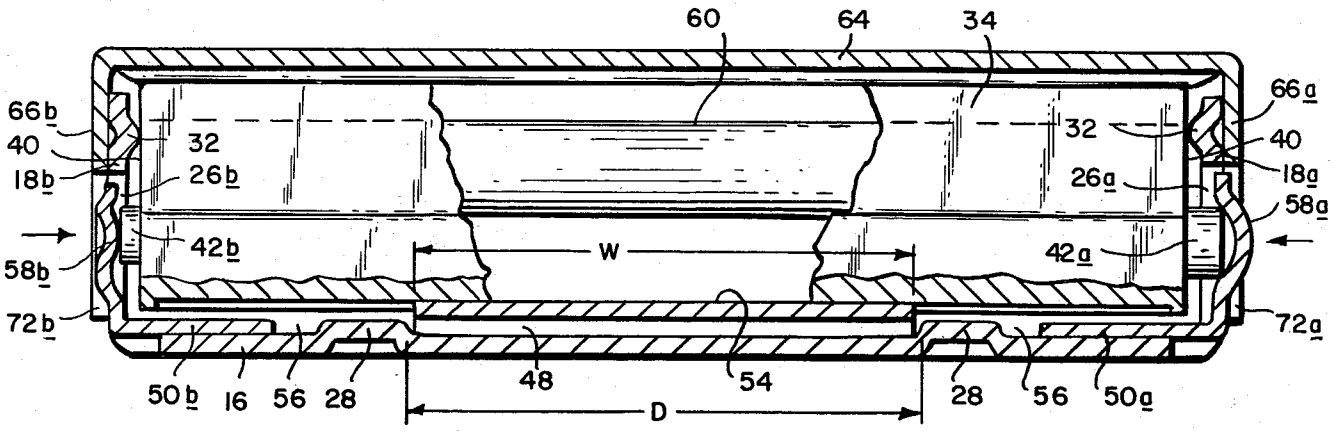

Referring now to the drawings, in FIGS. 1 and 2 a watch case 10 in accordance with the present invention is shown attached to opposite ends of an expansible linkage-type watch bracelet 12. Referring additionally to FIGS. 3–6, it will be seen that the watch case 10 includes a base component 14 consisting of a metal stamping having a bottom wall 16, opposed generally vertical side walls **18*a*, 18*b*, and upturned end walls 20. The end walls 20 have inturned flanges 22 which cooperate with the end walls and the bottom wall to define recesses generally indicated at 24. Access openings 26*a*, 26*b* are provided at the juncture of the side walls 18*a*, 18*b* with the bottom wall 16. Raised parallel ribs 28 on the bottom wall 16 are laterally spaced by a distance D. The side walls 18*a*, 18*b* are further provided with laterally aligned holes 30 and inwardly protruding nibs 32. The bottom, side and end walls of the base component cooperate in defining an open cavity C suitably dimensioned to receive an electronic watch module generally indicated at 34**.

The watch module is of the conventional type having a display face 36 protruding slightly above a top surface 38, and side surfaces 40 with laterally protruding depressible buttons **42*a*, 42*b*. Although not shown, it will be understood that the module 34 includes conventional internal function switches which are manually operated by depressing the buttons 42*a*, 42*b*. The ends of the module are laterally traversed by grooves 44**.

A spring member generally indicated at 46 is interposed between the module 34 and the base component 14. The spring member consists of a unitary metal stamping having a resilient central leaf 48 and resilient side leaves **50*a*, 50*b*, all extending forwardly from an upstanding transverse rib 52. The central leaf has a width W and a raised intermediate flat section 54. The width W is only slightly less than the distance D between the raised ribs 28 on the bottom wall 16 of the base component 14. The side leaves 50*a*, 50*b* are spaced laterally as at 56 from the central leaf 48, and each is provided respectively with an upturned contact section 58***a*, 58*b*.

The spring member 46 is designed to fit within the cavity C, with the central leaf 48 located between and held against lateral movement by the raised ribs 28 on the bottom wall 16, and with the contact sections 58*a*, 58*b* on the side leaves 50*a*, 50*b* protruding respectively through the access openings 26*a*, 26*b*.

The module 34 is received in cavity C on the raised intermediate flat section 54 of the central spring leaf 48. The sides 40 of the module are held between and located laterally by the inwardly protruding nibs 32 on the side walls 18*a*, 18*b*, and the depressible buttons 42*a*, 42*b* are located in alignment with the access openings 26*a*, 26*b* behind the spring contact sections 58*a*, 58*b*.

Fastening means comprising conventional spring bars 60 are employed to hold the module 34 downwardly against the upward resilient biasing force of the central spring leaf 48. Each spring bar is received in one of the transverse grooves 44 in the ends of the module, and the ends 60' of the spring bars are received in the aligned holes 30 in the base component side walls 18*a*, 18*b*. Thus, the module 34 is resiliently urged by the spring member 46 upwardly into a fixed position against the spring bars 60.

The watch case further includes a cover component generally indicated at 62 consisting of another unitary metal stamping having a top wall 64, side walls 66*a*, 66*b* and end walls 68. The top wall 64 has a viewing window 70, and the side walls 66*a*, 66*b* have notches 72*a*, 72*b* in their bottom edges and laterally aligned holes 74. The cover component is designed to be assembled onto the base component 14, with the display face 36 of the watch module 34 visible through the viewing window 70. When thus assembled, the side walls 66*a*, 66*b* of the cover component overlap the side walls 18*a*, 18*b* of the base component. The notches 72*a*, 72*b* are aligned with the access openings 26*a*, 26*b* to accommodate lateral outward protrusion of the spring contact sections 58*a*, 58*b*. The end walls 68 are spaced inwardly from the end walls 20 of the base component to thus overlie the recesses 24. The ends 60' of the spring bar 60 snap into the holes 74 in the side walls 66*a*, 66*b* to detachably secure the cover component in place.

As herein illustrated, the bracelet 12 is of the conventional type having box links 76 articulately connected by means of U-shaped staples 78. The staple legs are received in the links 76 and are spring loaded by internal springs 80. Each upper link is covered by a decorative top shell 82.

As shown in FIG. 5, the endmost links 76 of the bracelet 12 are received in the recesses 24 and are retained therein by the depending end walls 68 of the cover component 62. As illustrated, the decorative top shells 82 are plain, and the spaces 84 therebetween are decoratively matched by transverse grooves indicated typically at 86 in the top wall 64 of the cover component. It will be understood, however, that this decorative combination is merely one of many that can be employed in order to provide the watch case 10 and bracelet 12 with a pleasing continuous look as viewed in plan.

In light of the foregoing, it will be appreciated by those skilled in the art that the present invention offers a number of important advantages over the conventional prior art watch cases. To begin with, since the watch case consists of only three basic components (14, 46, 62), each being a unitary metal stamping and all being interconnected to each other and to the ends of a watch bracelet 12 by simple fastening means such as a pair of conventional spring bars 60, manufacturing and assembly costs are reduced to a minimum, thus making it possible to provide the watch case at low competitive prices.

The watch case can be disassembled by simply depressing the ends 60' of the spring bars 60. This facilitates access to the module 34 when changing batteries or the like.

The module control buttons 42*a*, 42*b* are completely hidden from view behind the spring contact sections 58*a*, 58*b*, with the metallic finish of the contact sections complimenting that of the base and cover components to thereby provide a neat finished appearance.

Manipulation of the module buttons 42*a*, 42*b* is facilitated by virtue of the fact that they are positioned behind the larger contact sections 58*a*, 58*b* of the spring leaves 50*a*, 50*b*. This also allows the size of the buttons 42*a*, 42*b* to be reduced to an absolute minimum, which in turn facilitates the task of providing water-tight seals between the buttons and the module housing.

The module 34 is tightly held within the watch case 10 due to the generally upward biasing action of the central spring leaf 48 and the lateral retention provided by the inwardly protruding nibs 32 on the base component side walls 18*a*, 18*b*.

I claim:

1. A case for containing an electronic watch module of the type having a display face and internal function switches manually operable by means of externally protruding depressible control buttons, said case comprising:

a base component defining an open cavity for receiving said watch module;

a cover component with a viewing window;

fastening means for detachably assembling said cover component to said base component at a position overlying said cavity, with the display face of the watch module in said cavity being observable through said window;

access openings in the assembled combination of said base and cover components in alignment with the control buttons on said watch module; and, spring means interposed between said watch module and said base component for resiliently urging said watch module into a fixed position within said case, said spring means having depressible contact sections arranged in said access openings to overlap and conceal said control buttons.

2. The case as claimed in claim 1 wherein said base component has a bottom wall underlying said watch module and opposed side walls extending along opposite sides of said watch module, said cover component has a top wall containing said window and opposed side walls externally overlapping the side walls of said base component, and said access openings extend through the side walls of both said components.

3. The case as claimed in claim 1 or 2 wherein said base component, cover component and spring means each consists of a unitary metal stamping.

4. The case as claimed in claim 2 wherein said spring means comprises a resilient first leaf interposed between the bottom of said watch module and the bottom wall of said base component, and resilient second leaves interposed between opposite sides of said watch module and the opposed side walls of said base component.

5. The case as claimed in claim 4 wherein said first and second leaves are integrally formed as a unitary metal stamping.

6. The case as claimed in claim 4 wherein said control buttons protrude laterally from opposite sides of said watch module, and wherein said second leaves include said contact sections, whereupon depression of said contact sections into said access openings will produce a resilient flexure of said second leaves and an accompanying depression of said control buttons.

7. The case as claimed in claim 6 further comprising alignment means on said base component for opposing movement of said first leaf when said second leaves are resiliently flexed.

8. The case as claimed in claim 7 wherein said alignment means comprises parallel ribs on the bottom wall of said base component, said ribs being spaced laterally one from the other to fixedly retain said first leaf therebetween.

9. The case as claimed in claim 1 wherein said fastening means comprises spring bars, the ends of which are received in aligned holes in said base and cover components.

10. The case as claimed in claim 9 wherein said spring means is operative to resiliently urge said watch module against said spring bars.

11. The case as claimed in claim 1 further comprising connecting means cooperatively defined by said base and cover components for connecting said case to the opposite ends of a watch band.

12. The case as claimed in claim 11 wherein said watch band is of the linkage type having transversely extending link members joined for articulate movement relative to each other, and wherein said connecting means comprises end walls on said base and cover components, each end wall on said base component being upturned and having an inturned flange defining a recess for receiving a link member at one end of said watch band, and each end wall of said cover component being downturned towards said recess to retain said link member therein.

* * * * *